United States Patent [19]

Simon

[11] 3,988,791

[45] Nov. 2, 1976

[54] SLEEPING BAG

[75] Inventor: William N. Simon, 1441 Del Mar Ave., Berkeley, Calif. 94708

[73] Assignee: Snow Lion Corporation, Berkeley, Calif.

[22] Filed: Feb. 10, 1975

[21] Appl. No.: 548,519

[52] U.S. Cl. ..... 5/343

[51] Int. Cl.[2] ..... A47G 9/00

[58] Field of Search ..... 2/2.1 R, 81, 85, 87, 2/97, DIG. 2, 69.5; 24/205 R; 5/343, 336

[56] References Cited

UNITED STATES PATENTS

| | | | |
|---|---|---|---|
| 983,223 | 1/1911 | Fitch | 2/69.5 |
| 1,371,841 | 3/1921 | Berkwits | 2/DIG. 2 |
| 2,277,492 | 3/1942 | Kamhi | 2/DIG. 2 |
| 2,379,416 | 7/1945 | Clark | 5/343 X |
| 3,102,570 | 9/1963 | Fairchilds | 24/205.1 R X |
| 3,584,323 | 6/1971 | Worley | 5/343 |
| 3,787,906 | 1/1974 | Hunt | 5/343 |
| 3,831,206 | 8/1974 | Geary | 5/343 |

*Primary Examiner*—Casmir A. Nunberg
*Assistant Examiner*—Andrew M. Calvert

[57] ABSTRACT

A sleeping bag having double shells, an inner shell and an outer shell both open at one and the same side, each preferably differentially cut so that the sleeping bag is narrow at the bottom or foot end than at the upper end, and having insulating material between said shells, said shells being closed along said open side by a pair of off-set slide fasteners, said off-sets providing effective closing off of any leakage through the fasteners of the warmed air inside the sleeping bag and the entry of cold air from the outside and providing both a dead air space between said double fasteners and insulated pads to cover the two closures.

3 Claims, 2 Drawing Figures

SLEEPING BAG

BACKGROUND OF THE INVENTION

The commercial development of the sleeping bag has been one of opportunism and myth. While all sorts of insulating materials have been used in sleeping bags the development of the down bag brought advertising campaigns with resulting misconceptions concerning various properties and characteristics of down and the unfavorable impressions regarding sleeping bags.

Traditionally sleeping bags were made with double walls and filled with various types of insulating material. They were bags of the same width from top to bottom and manufactured without zippers, or other closing means so that the user had to crawl in from the top and work his way down into the bag for proper rest. This was more efficient than was realized at first, because there was no opportunity for cold air entry or interior heat to escape except at the top. Zippers and other closures were added for convenience and quick operation, but zippers particularly, due to their construction, produced cold seams which are a factor in reducing the efficiency of the sleeping bag. In Europe zippers are not used because of the cold seam. It is now generally conceded that an efficiently made sleeping bag provides a layer of dead air, i.e. insulation around ones body. The thicker the layer of insulation, all other things being equal, the greater the warmth of the bag. However, the layer of insulation does not produce warmth, it simply traps body heat. With the recognition of these basic circumstances sleeping bags were made narrower and mummy-like in form. In this manner two inches of uniform insulation on a wide bag of the old style is less efficient than a narrow or tapered bag with the same two inch thickness of insulation because there is less inside air space to be heated by the body trapped in the insulation.

As stated earlier, the problem of preventing cold air from entering, and heat escaping through the zipper, arose with the advent of the zipper closure. Prior to the double zipper as disclosed herein, there were numerous attempts to stop the cold air seams and the escape of heat by the use of down-filled draft flaps located on the inner side of the sleeping bag along the sewing line of the zipper. Sometimes the flap was on the upper side of the zipper, sometimes it was on the lower side, and even in some instances on both sides of the zipper. These flaps were flexible, non-stationary projections which when properly aligned were intended to cover the zipper connection on the inside of the sleeping bag. Unfortunately, because these flaps were easily collapsed, or tended to move away from the zipper connection, the protection was inconsistent and the performance unsatisfactory. In addition, because they were connected to a portion of the bag a cold air inlet or a heat juncture was always present.

SUMMARY OF THE INVENTION

The double zipper sleeping bag of the present invention substantially eliminates the possibility of warm air leaks and cold air entry through the zipper closures and thus ends one of the most trying problems of modern sleeping bag manufacture.

Although it is not one of the prime objectives, a feature of the double zipper as disclosed is its ability to turn a single sleeping bag into a double bag by conjunction with another double zipper sleeping bag, without destroying the seal preventing the exit of warm air and the influx of cold outside air.

Another feature of the present invention is that the double zipper not only has the locking of the draft flaps firmly and completely over the outer zipper but it creates an additional dead air space between the two zippers providing insulation at the most critical seam.

In all of these, as well as others which are clearly apparent as the description proceeds the double zipper as shown and described herein effectively restores the type of uniform fine insulation previously found only in zipperless sleeping bags, while still providing the convenience and versatility of zipper closures.

In order to provide the necessary room for the double zipper the sleeping bag is constructed with a differential cut with a resultant thermos bottle effect. In making the differential cut the inner shell is cut narrower than the outer shell to provide uniform insulation around the body. In so doing this provides insulation around protruding knees and elbows and not only prevents, but substantially eliminates pushing the insulation aside at any point thus reducing the thickness of the insulating barrier. As a result of this cutting it has been discovered that a sleeping bag is as warm as its weakest point of insulation.

Thus it has been discovered that the differential cut between the inner and outer shells is superior to shells of equal dimensions such as parity.

A further advantage is that the interior girth of the sleeping bag may be adjusted to a wide or narrow dimension by the use or disuse of the inner zipper. This creates two comfort positions regarding the room space required to be heated. The less air space internally the less to be heated.

Another advantage is that when the inner zipper is used, greater insulation is achieved by increasing the bags differential dimension.

A further and important advantage is that the inner zipper serves as a back-up to the outer zipper in case the outer zipper fails for any reason.

Further objects are to provide a construction of maximum simplicity, economy and ease of assembly and disassembly, also such further objects, advantages and capabilities as will fully appear and as are inherently possessed by the device and invention described herein.

The invention further resides in the combination, construction and arrangement of parts illustrated in the accompanying drawings, and while there is shown therein a preferred embodiment thereof, it is to be understood that the same is illustrative of the invention and that the invention is capable of modification and change and comprehends other details of construction without departing from the spirit thereof or the scope of the appended claims.

DESCRIPTION OF PREFERRED EMBODIMENTS

Figure 1:
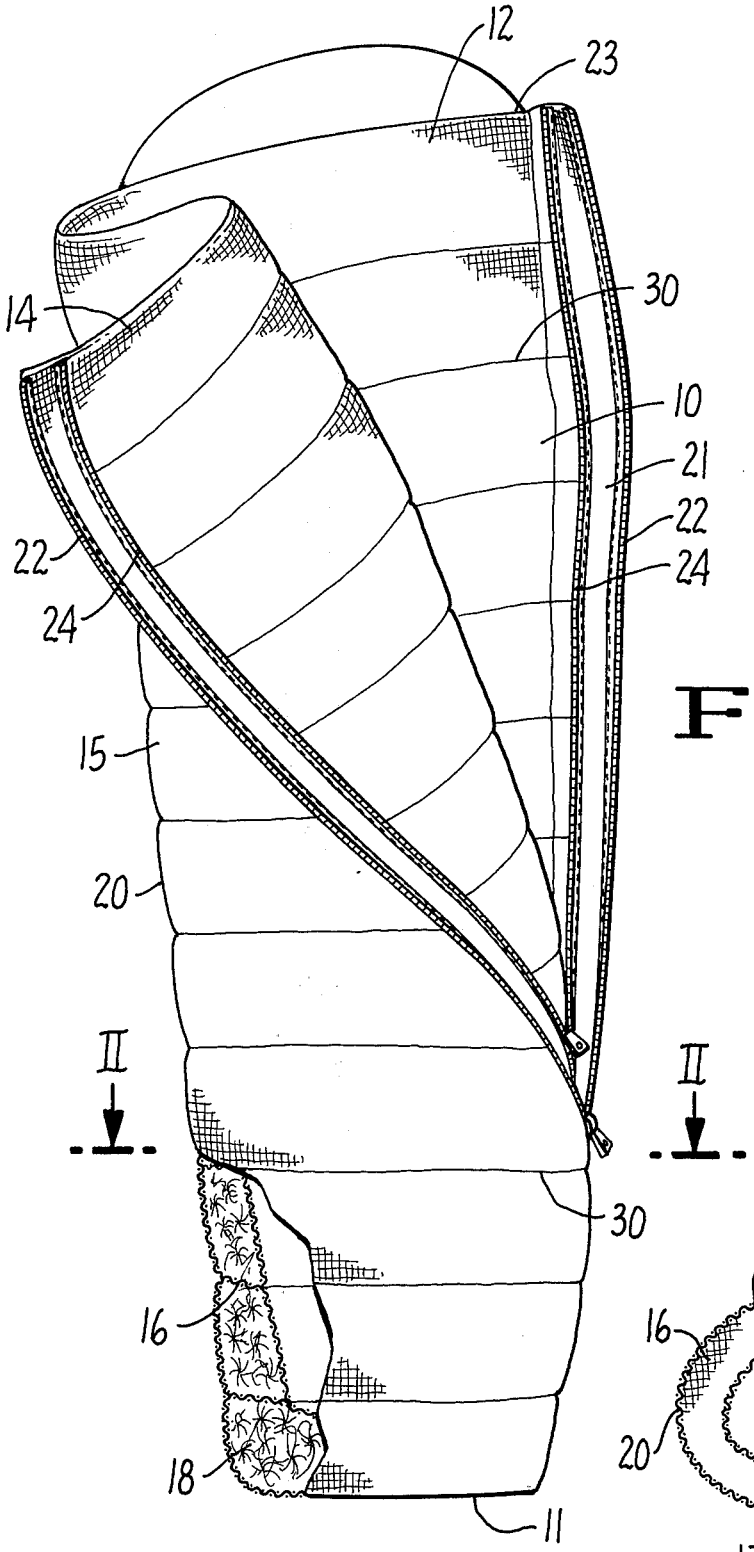
FIG. 1 is a perspective view of he sleeping bag of the present invention giving primarily a top plan, with a portion thereof cut away to show the differential cut.

Referring now more particularly to the drawing in which like referenced numerals are used to identify like parts or portions in the several views, and with particular reference to FIG. 1, the sleeping bag as disclosed herein, is shown in perspective-plan view and is numbered 10. The sleeping bag 10 could be classed as a mummy-type bag in which the bottom end 11 is narrower in width than the open upper portion 12. The bag consists of an inner shell 14 and an outer shell 15. Both shells are preferably made from 1.9 ounce ripstop nylon yard goods which is somehwat more water and wind repellent than most other materials which are light weight in character.

In making the inner and other shells 14 and 15, it is preferable to use what is known as the differential cut. By this is meant that the inner shell 14 is substantially less in circumference than the outer shell 15. In order to hold the two shells in proper spaced relationship, amongst other benefits, horizontal baffles of nylon mesh 16 are used and are set preferably in 5 inch tube widths. The sewing of the horizontal baffles 16 between the shells 14 and 15 is designated 30. The tube baffles 16 are prepared in two styles. One is the slant wall style 17 shown in a portion of FIG. 2, and the other is the over-lapping "V" tube 18 shown in a portion of FIG. 2. Other baffles such as side block baffles, also of nylon mesh, may be used to prevent the down or other insulation from shifting from one side to the other, and corner block baffles preventing the down from turning the corner from one tube to the other. Great care is taken so that there is no shifting of the insulating material from one location to the other and so prevent cold spots at stressed points in use. Regardless of the manner of construction or the placement of the baffles, the baffle tubes are filled with down or other appropriate insulation.

The outer shell 15 which folds over at the side edge at 20 to form an open envelope, is closed at the opposite side 21 by a suitable zipper or other closure means, preferably a sliding closure 22. The zipper closure 22 may run the full length of the sleeping bag 10 from the bottom 11 to the upper opening 23. If the sleeping bag is also intended for use as a down puff or the like, the zipper 22 may be extended around the bottom edge 11 so that the whole bag opens up flat.

Figure 2:
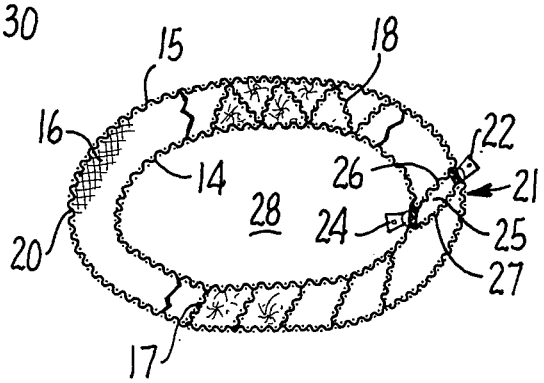
FIG. 2 is a transverse section taken on the line II—II of FIG. 1.

The inner shell 14 is provided with another zipper or other closure means 24 which is positioned off-set from zipper 22. When the zippers 22 and 24 are closed the off-set provides a dead air pocket 25 between the outer and inner shells as shown in FIG. 2.

It should be pointed out that the zippers or other closures 22 and 24 may be double ventilated, i.e. the zipper may be activated from either top or bottom thereby permitting ventilation from either end. It should also be pointed out that the off-set of zippers 22 and 24 provide down-filed draft flaps 26 and 27.

OPERATION

As has been described earlier the sleeping bag 10 shown in FIG. 1, is made as efficiently as possibly to keep the down or other insulating material within the baffle tubes formed of nylon mesh 16-17-18, as evenly distributed as possible over the entire areas. The insulation material, of course, does not produce the warmth. It simply body heat. By using the differential cut, i.e. the mummy type, the bag is warmer because there is less inside air space to be heated. The problem of preventing cold air from entering and heat escaping through the zipper closure has been substantially solved by the off-set double zipper closures 22 and 24. The accomplishment of this result is best shown by reference to FIG. 2. When the outer zipper 22 is closed in the manner shown, the same old problem arises that cold air filters in through the zipper closure and warm air escapes from the inside 28 through the zipper closure 22 to the outside. However, when the inner zipper 24 is closed as shown the down filled flap 26 covers the zipper closure 22 and permits the down filled flap 27 to cover the zipper closure 24. In this manner no cold air gets into the interior 28 sleeping bag and no warm air escapes out through the zipper closure 22 or 24. In addition, the dead air space 25 between the two closures further eliminates the possibility of the entry of cold air and the escape of warm air to and from the interior of the bag 10.

The interior girths of the sleeping bag 10 may also be adjusted to make a wide or narrow dimension by the use or disuse of the inner zipper. For example, if only the outer zipper is closed then the inner dimension of the sleeping bag is increassed providing additional room and space required for use. On the other hand if only the inner ziper 24 is closed, then there is less internal space to be heated with air filtering through the closure. In this manner there are three comfort positions possible by the use of either one of the zipper closures or both, providing various degrees of room within the sleeping bag and space required to be heated.

It is also to be pointed out that when the inner zipper 24 is used, greater insulation is achieved by decreasing the bag's differential dimension.

The use of the double zipper off-set as shown and described herein is added protection. The inner zipper 24 serves as a backup to the outer zipper 22, in the event there is a failure.

Although many have tried to solve the zipper closure problems of eliminating the entry of cold air and the escape of warm heated air, only the double zipper off-set closure, as disclosed herein has solved this problem efficiently and with a minimum of added weight. Thus, one of the great discomforts of zipper or other closure for sleeping bags is eliminated as well as providing many additional benefits.

I claim:

1. A sleeping bag for backpacking and the like, having a unitary construction comprising inner and outer shells open at one and the same side, tubular baffles of nylon mesh for receiving and retaining the insulating material and holding the inner and outer shells in spaced relation, insulating material in said tubular baffles, and a pair of continuous slide fastening means along the open side for closing the open side, said fastening means being off-set with respect to each other providing a dead air space there between so as to prevent leakage through the closure means and keep the heated air in and the cold air out of the interior of said sleeping bag.

2. A sleeping bag of claim 1 wherein the inner and outer shells are differentially cut with the inner shell smaller to provide uniform insulation in all places and still form a bag which is narrower at the bottom than at the top.

3. The sleeping bag of claim 1 wherein there is an internal insulated flap portion adjacent the outer off-set closure means, which bears against and provides an insulated pad for covering said inner off-set closure means, and an internal insulated flap portion adjacent the inner off-set closure means which bears against and provides an insulated pad for covering said outer off-set closure means.

* * * * *